US008573133B2

(12) United States Patent
Mollet

(10) Patent No.: US 8,573,133 B2
(45) Date of Patent: Nov. 5, 2013

(54) PASSENGER TRANSPORT INSTALLATION COMPRISING INDEPENDENT VEHICLES TRAVELLING ON TRACKS AND HAULED BY CABLES, AND METHOD FOR TRANSPORTING PASSENGERS

(75) Inventor: Alain Mollet, Annecy le Vieux (FR)

(73) Assignee: Pomagalski, Voreppe (FR)

( * ) Notice: Subject to any disclaimer, the term of this patent is extended or adjusted under 35 U.S.C. 154(b) by 279 days.

(21) Appl. No.: 12/887,587

(22) Filed: Sep. 22, 2010

(65) Prior Publication Data

US 2011/0226152 A1 Sep. 22, 2011

Related U.S. Application Data

(60) Provisional application No. 61/244,508, filed on Sep. 22, 2009.

(51) Int. Cl.
*B61B 9/00* (2006.01)

(52) U.S. Cl.
CPC ..... *B61B 9/00* (2013.01)
USPC ..... 104/178; 104/173.1

(58) Field of Classification Search
CPC ..... B61B 9/00; B61B 12/10; B61B 7/02; B61B 7/045
USPC ..... 104/173.1, 179, 178, 202, 204, 239, 104/238, 60
See application file for complete search history.

(56) References Cited

U.S. PATENT DOCUMENTS

| | | | | |
|---|---|---|---|---|
| 3,871,303 | A | 3/1975 | Woodling | |
| 4,092,929 | A * | 6/1978 | Laurent | 104/173.1 |
| 4,563,955 | A | 1/1986 | Tarassoff | |
| 4,627,361 | A | 12/1986 | Tarassoff | |
| 4,641,584 | A | 2/1987 | Bertrand | |
| 4,641,585 | A | 2/1987 | Tarassoff | |
| 4,662,285 | A | 5/1987 | Rossignol | |
| 4,669,389 | A | 6/1987 | Tarassoff | |

(Continued)

FOREIGN PATENT DOCUMENTS

| | | |
|---|---|---|
| DE | 644714 | 5/1937 |
| EP | 1 193 153 | 4/2002 |
| FR | 2 658 772 | 8/1991 |

OTHER PUBLICATIONS

Fr 2 658 772 (only pp. 1-3, English translation of Description section, Aug. 30, 1991).*

*Primary Examiner* — Mark Le
(74) *Attorney, Agent, or Firm* — Harness, Dickey & Pierce, P.L.C.

(57) ABSTRACT

A public passenger transport installation includes two end stations connected via two tracks for inbound and outbound travels. At each station, both tracks join into a common single connector track section via a switch. Each of the tracks is associated with at least two endless cables, which extend from one of the station to the other one, and more precisely from one of the connector track section to the other. The endless cables associated with one track run in parallel to one another, and are laterally offset with respect to one another by a given distance, which is constant along the track and at the stations. Vehicles provided with releasable clamps can be individually coupled to the cables. Each clamp is movable between at least four indexed lateral positions, each corresponding to one of the cables on the connector track section. Each cable can be individually driven at continuously variable speed between standstill and a cruising speed.

20 Claims, 4 Drawing Sheets

(56) References Cited

U.S. PATENT DOCUMENTS

| | | | |
|---|---|---|---|
| 4,691,643 | A | 9/1987 | Brochand |
| 4,693,033 | A | 9/1987 | Tauzin |
| 4,712,486 | A | 12/1987 | Tarassoff |
| 4,742,777 | A | 5/1988 | Tarassoff |
| 4,868,887 | A | 9/1989 | Bertrand |
| 4,898,100 | A | 2/1990 | Brochand |
| 4,953,468 | A | 9/1990 | Creissels |
| 5,159,880 | A | 11/1992 | Mugnier |
| 5,172,640 | A | 12/1992 | Cathiard |
| 5,188,037 | A | 2/1993 | Mugnier |
| 5,226,368 | A | 7/1993 | Brochand et al. |
| 5,383,407 | A | 1/1995 | Souchal |
| 5,419,261 | A | 5/1995 | Tarassoff et al. |
| 5,465,668 | A | 11/1995 | Tarassoff et al. |
| 5,517,923 | A | 5/1996 | Cathiard |
| 5,520,116 | A | 5/1996 | Toyre |
| 6,290,425 | B1 | 9/2001 | Cathiard et al. |
| 6,332,406 | B1 | 12/2001 | Mugnier |
| 6,513,440 | B1 | 2/2003 | Huard et al. |
| 2006/0131940 | A1 | 6/2006 | Coudurier et al. |
| 2007/0250244 | A1 | 10/2007 | Revenant |
| 2007/0283840 | A1 | 12/2007 | Huard et al. |
| 2007/0284219 | A1 | 12/2007 | Michel |
| 2009/0013894 | A1 | 1/2009 | Marguet et al. |
| 2009/0064890 | A1 | 3/2009 | Charrere et al. |
| 2009/0205530 | A1 | 8/2009 | Mollet |
| 2009/0293601 | A1 | 12/2009 | Huard et al. |

* cited by examiner

PASSENGER TRANSPORT INSTALLATION COMPRISING INDEPENDENT VEHICLES TRAVELLING ON TRACKS AND HAULED BY CABLES, AND METHOD FOR TRANSPORTING PASSENGERS

CROSS-REFERENCE TO RELATED APPLICATIONS

This application claims the benefit of U.S. Provisional Application No. 61/244,508, filed on Sep. 22, 2009, which is incorporated by reference herein.

TECHNICAL FIELD OF THE INVENTION

This invention relates to a transport installation between two end stations, using traction cables for moving independent vehicles along two main tracks.

BACKGROUND ART

Transport installations making use of passive vehicles hauled along a track by traction cables are well known in the art.

FR 2 658 772 discloses a funicular including two hauling cables independent of one another and driven by separate motors for moving two vehicles between two stations. The tracks a middle siding section where the two vehicle can circulate simultaneously in different section and two end sections where only one vehicle can be at any given time. One of the cables is coupled to one of the vehicles, and the other cable to the other vehicle. Each vehicle is independent of the other and can move or even stop independently of the other vehicle. However, it is not easy to efficiently operate the installation when the number of passengers heavily fluctuates. Moreover, the installation is not adapted to long distances, since one vehicle only can travel at any given time in one direction.

The U.S. Pat. No. 3,871,303 describes a transport installation comprising individual passive vehicles able to move along a track, each vehicle being equipped with a detachable grip for coupling on to a first haulage cable in continuous movement, corresponding to a cruising speed for the vehicles and stretching along the cruising sections of the said track so as to haul in synchronism the successive vehicles coupled on to the cable. A device operates the grip actuating the coupling and uncoupling respectively of the vehicle at the entrance to and at the exit from a cruising section by the attaching to and detaching from the said haulage cable of the grip. A second haulage cable stretches along auxiliary sections of track and in cable changeover zones parallel with the first cable, the said vehicle being capable of being coupled on to the said second cable. The transport vehicle is equipped with several independent coupling grips, each of these being able to work in conjunction with a predetermined cable, respectively for haulage on the line, for deceleration and for acceleration. However, the use of independent grips may be the origin of incidents and necessitates safety controls and interlocking systems, the compatibility of which with operating conditions presents difficulty.

U.S. Pat. No. 4,092,929 discloses a transport installation comprising individual passive vehicles each equipped with a triple grip for coupling the vehicle to a main haulage cable extending along the track or to auxiliary haulage cables for instance acceleration and deceleration cables at a station. One pair of jaws of the grip is open when the two other pairs of jaws are in the coupling position and conversely.

EP 1 193 153 discloses an installation for moving vehicles pulled by a cable, comprising two or more stations, the vehicles travelling on at least one track between the stations, each vehicle comprising at least one gripper, able to move between at least two positions and able to come into engagement with a tractor cable. The installation comprises several tractor cables each mounted in a loop, the said loops extending vertically parallel to the track, one after the other, the ends of two successive cable loops being sufficiently close to each other to enable the gripper to release the cable of the previous loop and to grip the cable of the following loop. More specifically, the installation comprises a first and second succession of cable loops for pulling the vehicle in respectively an outward and a return direction, the vehicles changing direction at the end of the line, and a single travel track, the two cable loops providing the traction in the outward and return directions respectively extending parallel to the single track, close to each other, so that the gripper can easily pass from one cable to another. The single track divides locally into two outward and return tracks, each associated with a respective outward and return tractor cable loop, so that two vehicles travelling in opposite directions can pass each other, the two outward and return tracks joining again in order to form a single track again. This installation is particularly flexible since, a vehicle, to decelerate, call at intermediate stations and accelerate again on the track independently from the other vehicles. A vehicle is even able to change direction of movement whilst travelling on the single track. However, this flexibility comes at a very high price in terms of complexity of the installation and of its operation.

In German patent DE 644,714, a transport installation for use in potash mines is described. The installation includes two independent rope loops driven in parallel in the same direction along an outbound and an inbound path. Mine cars travelling on the two paths are permanently secured to one or the other of the two ropes. Successive mine cars are alternatively secured to one or the other of the two ropes. Hence, the capacity of the installation is doubled. However, any incident on one of the ropes results in the whole installation being stopped. Moreover, the installation is not adapted to the transport of passengers since the mine cars are not supposed to stop at the end of the outbound or inbound paths.

SUMMARY OF THE INVENTION

The foregoing shortcomings of the prior art are addressed by the present invention. According to one aspect of the invention, there is provided a transport installation comprising:

- two end stations;
- independent vehicles;
- a first and a second track, each supporting and guiding the vehicles from one of the two end stations to the other;
- individually hauling one of the vehicles along the first track from one of the two end stations to the other;
- a plurality of second endless traction cables associated with the second track, each for individually hauling one of the vehicles along the second track from one of the two end stations to the other;
- coupling means for individually coupling the vehicles to any one of the first and second endless traction cables;
- driving means for independently driving each of the first and second cables.

The term "cable" used throughout the text is generic and is used as a synonym for rope or line.

The vehicles are hauled from one station to the other by one and the same cable, which avoids changes en route and increases the overall comfort. The installation is particularly well adapted to a transport line between two end stations without intermediate stop. However, it is very flexible and can be adapted to an installation with intermediate stops. More importantly, an installation originally running with two end stations only can be at a later stage equipped with one or several further intermediate station on one or both tracks.

As each of the endless traction cables is individually driven by the driving means and can haul vehicles from one of the stations to the other, and the vehicle can be individually coupled to and uncoupled from any one of the cables, the operation of the installation is very flexible and can easily be adapted to the number of passengers at any time. The tracks can be rail tracks or roads and the vehicles can be supported on wheels and/or air cushions.

Preferably, the coupling means include detachable cable grips mounted on each of the vehicles. According to a preferred embodiment, each of the detachable grips is movable between at least four positions offset laterally in relation to each other. Each of the four positions enables the grip to clamp a respective one of the first and second endless traction cables. In this respect, all the vehicle are identical and able to travel on any one of the tracks, driven by any one of the corresponding cables.

Preferably, the first cables are laterally offset with respect to one another by a distance which is constant along the first track. Hence, if a vehicle stops on one of the tracks due to a failure of the driving means or cable, it is possible to easily stop the adjacent cable, and to clamp the vehicle to the adjacent cable. This can even be done remotely, if the indexation of clamp and the location of the cables are precise enough. Preferably, the second cables are laterally offset with respect to one another by a distance which is constant along the second track and equals the distance between the cables associated with the first track.

Advantageously, each of the stations may include a connector track section, where the first and second cables are parallel and laterally offset with respect to one another, such that any one of the vehicles staying on the connector track section can switch from any one of the first and second the cables to any other one. The single connector track section of each of the end stations is connected to the first and second track via a switch. Synchronisation means can be provided for controlling the driving means such that none of the vehicles enters one the connector track section whilst another of the vehicles is on the connector track section.

Preferably, the cable speed can be varied by the driving means from zero to a cruising speed and back to zero. Hence, one and the same cable is used for hauling a given vehicle from the connector track of one end station to the connector track of the other end station. The leaving and coasting phases are smooth and do not generate noise at the stations or in the vehicles, so that the comfort for passengers is optimal.

According to a preferred embodiment, the cables of the first and second pairs are located below the first and second tracks, respectively. The installation may be provided with collision prevention means including means for detecting a loss of traction of any one of the cables of any given one of the first and second cables and for controlling the traction of the other cables associated with the same track in a failsafe mode upon detection of said loss of traction.

According to a further aspect of the invention, there is provided a method for transporting passengers between two end stations comprising:

clamping a first vehicle to a first cable at the first station and hauling the first vehicle clamped to the first cable along a first track in a first direction from the first end station to the second end station;

clamping a second vehicle to a second cable at the first station and hauling the second vehicle clamped to the second cable along the first track in the first direction from the first end station to the second end station after the first vehicle has left the first end station;

releasing the first vehicle from the first cable and clamping the first vehicle to a third cable at the second station, and hauling the first vehicle clamped to the third cable along a second track in a second direction from the second end station to the first end station;

releasing the second vehicle from the second cable and clamping the second vehicle to a fourth cable at the second station, and hauling the second vehicle clamped to the fourth cable along the second track in the second direction from the second end station to the first end station after the first vehicle has left the second end station.

Upon detection of an undesired stop of first cable while the first vehicle is travelling on the first track between the first end station and the second end station, the method may include a rescuing procedure including:

stopping the second cable;

releasing the first vehicle from the first cable and clamping the first vehicle to a second cable;

hauling the first vehicle clamped to the second cable along the first track in the first direction to the second end station.

BRIEF DESCRIPTION OF THE DRAWINGS

Other advantages and features of the invention will become more clearly apparent from the following description of specific embodiments of the invention given as non-restrictive examples only and represented in the accompanying drawings in which.

DETAILED DESCRIPTION OF ONE EMBODIMENT

Figure 1:
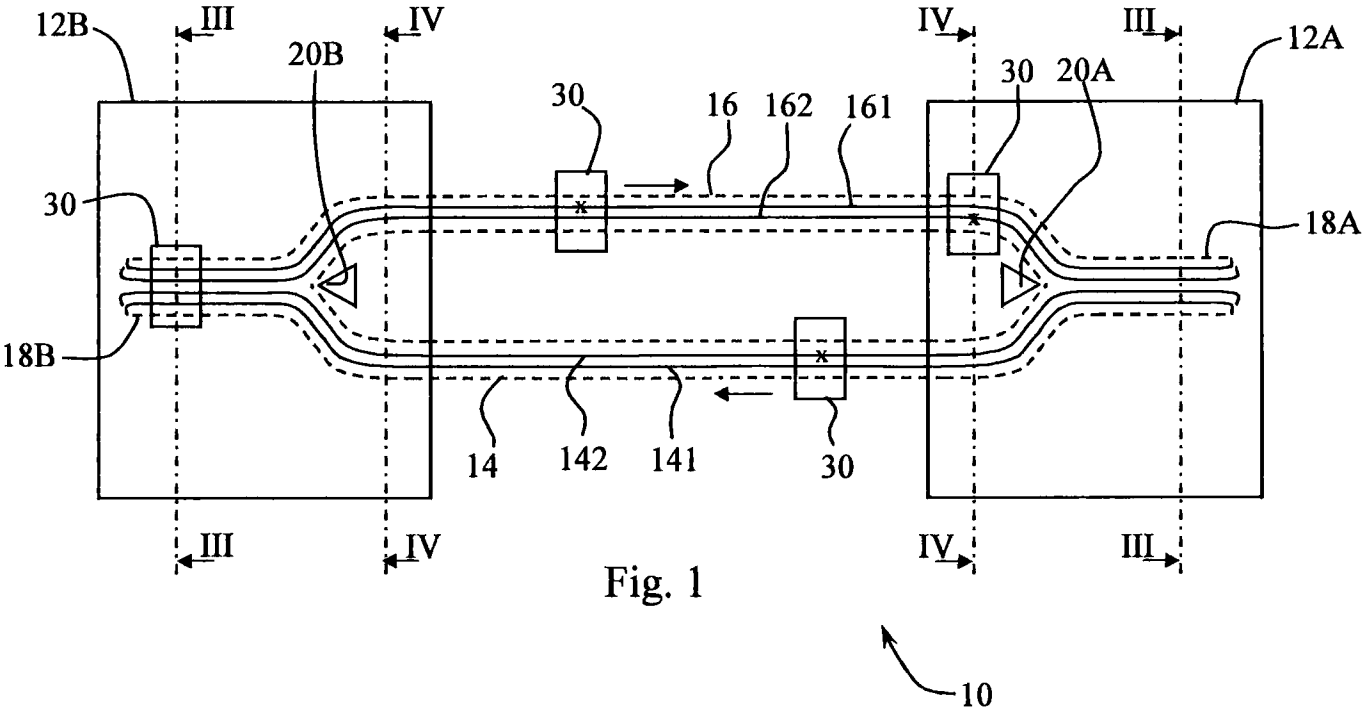
FIG. 1 is a diagrammatic plan view of a passenger transport installation according to one embodiment of the invention.

Referring to FIG. 1, a public passenger transport installation 10 includes two end stations 12A, 12B interconnected via two tracks 14, 16 for inbound and outbound travels. At each end station, both tracks 14, 16 join into a common single connector track section 18A, (see FIG. 3) 18B via a switch 20A, 20B. Before the junction, the station is provided with a platform 22 (see FIG. 4) to let passengers board and alight. Remarkably, in this embodiment the installation does not include any intermediate stop or station.

Figure 2:
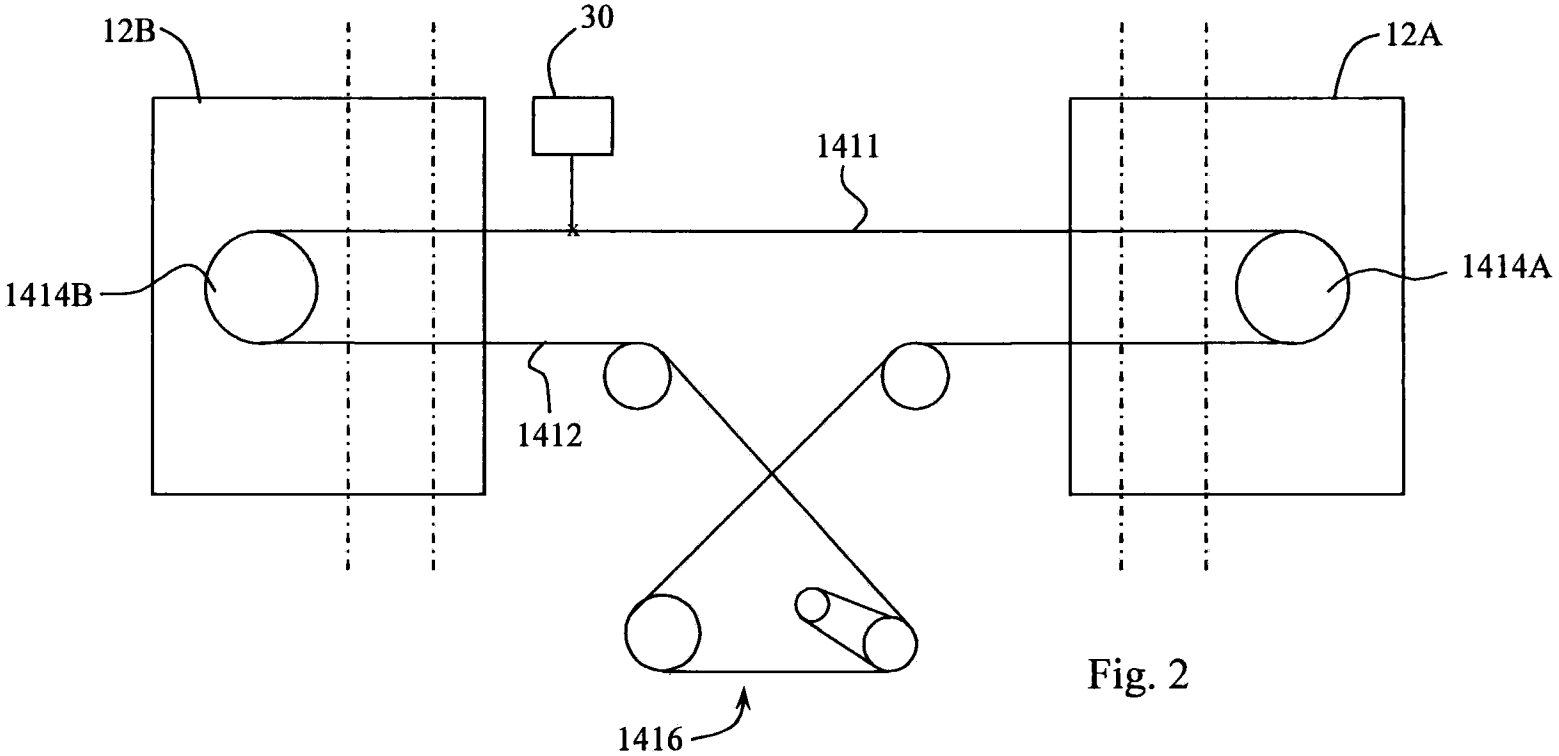
FIG. 2 is a diagrammatic view illustrating a driving unit for powering a cable of the installation of FIG. 1.

Each of the tracks 14, 16 is associated with at least two endless cables 141, 142, resp. 161, 162, which extend from one of the station to the other one, and more precisely from one of the connector track sections 18A, 18B to the other. The endless cables 141, 142, resp. 161, 162 associated with one track 14, resp. 16 run in parallel to one another, and are laterally offset with respect to one another by a given distance, which is constant along the track and at the stations. The endless cables 141, 142, 161, 162 are located below the track, at a vertical distance which is preferably constant. The lateral direction referred to above is the direction transverse to the path of motion defined by the track. At each connector track section 18A, 18B, all the endless cables, i.e. the cables associated with the two tracks 14, 16, run in parallel, as depicted in FIG. 2.

Vehicles 30 provided with releasable clamps 32 (FIG. 3) can be individually coupled to the cables 22, 24, 26, 28. Each clamp 32 is movable between at least four indexed lateral positions P1, P2, P3 and P4, each corresponding to one of the cables on the connector track section. As the position of the cables associated with one of the tracks is constant with respect to the track and to one another, and is the same on the connector track section and on the inbound and outbound tracks, vehicles stopped on one of the inbound or outbound tracks can switch between the two available cables.

Figure 3:
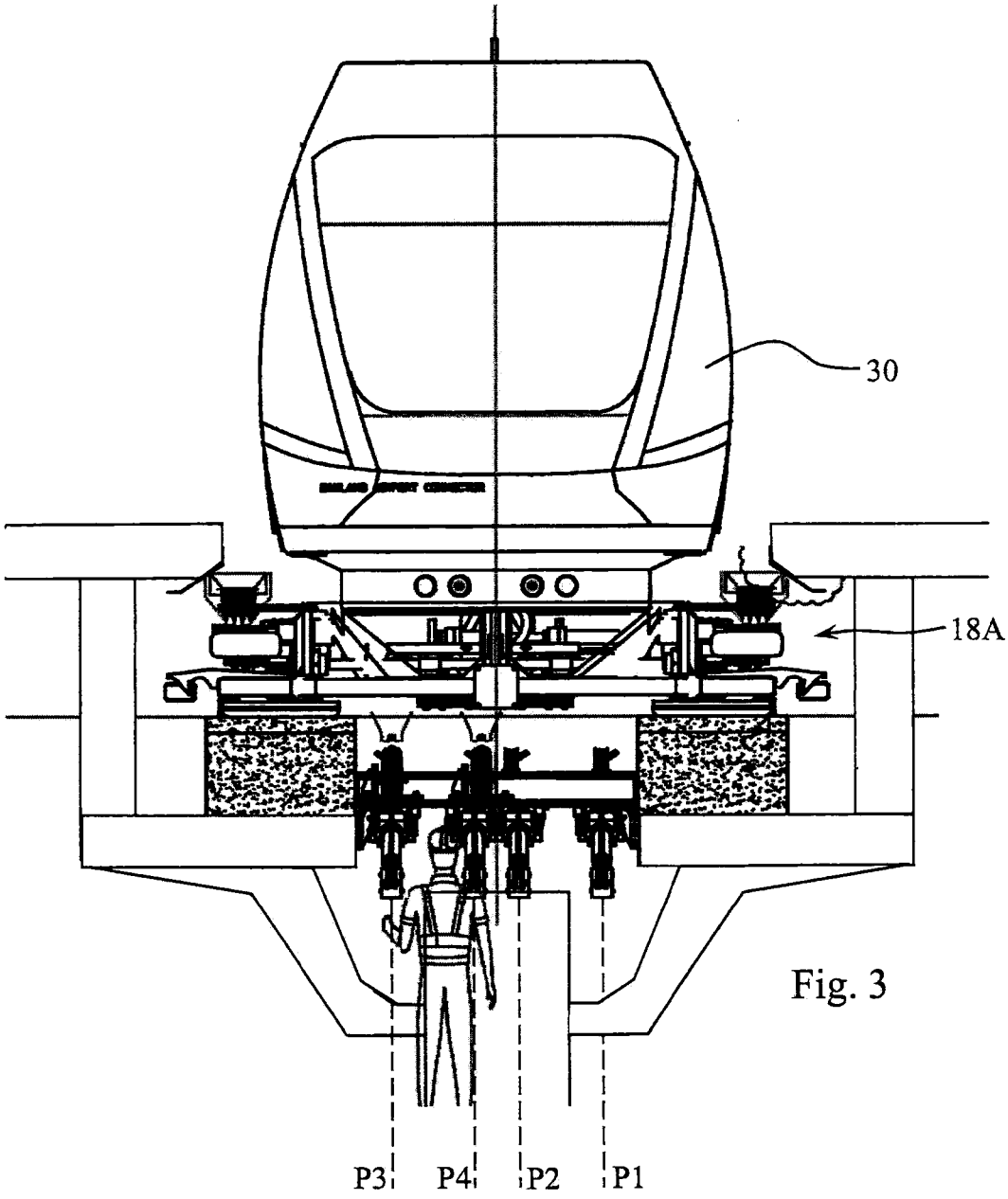
FIG. 3 is a section of the installation along plane III-III of FIG. 1, showing a connector track section of the installation.
Figure 4:
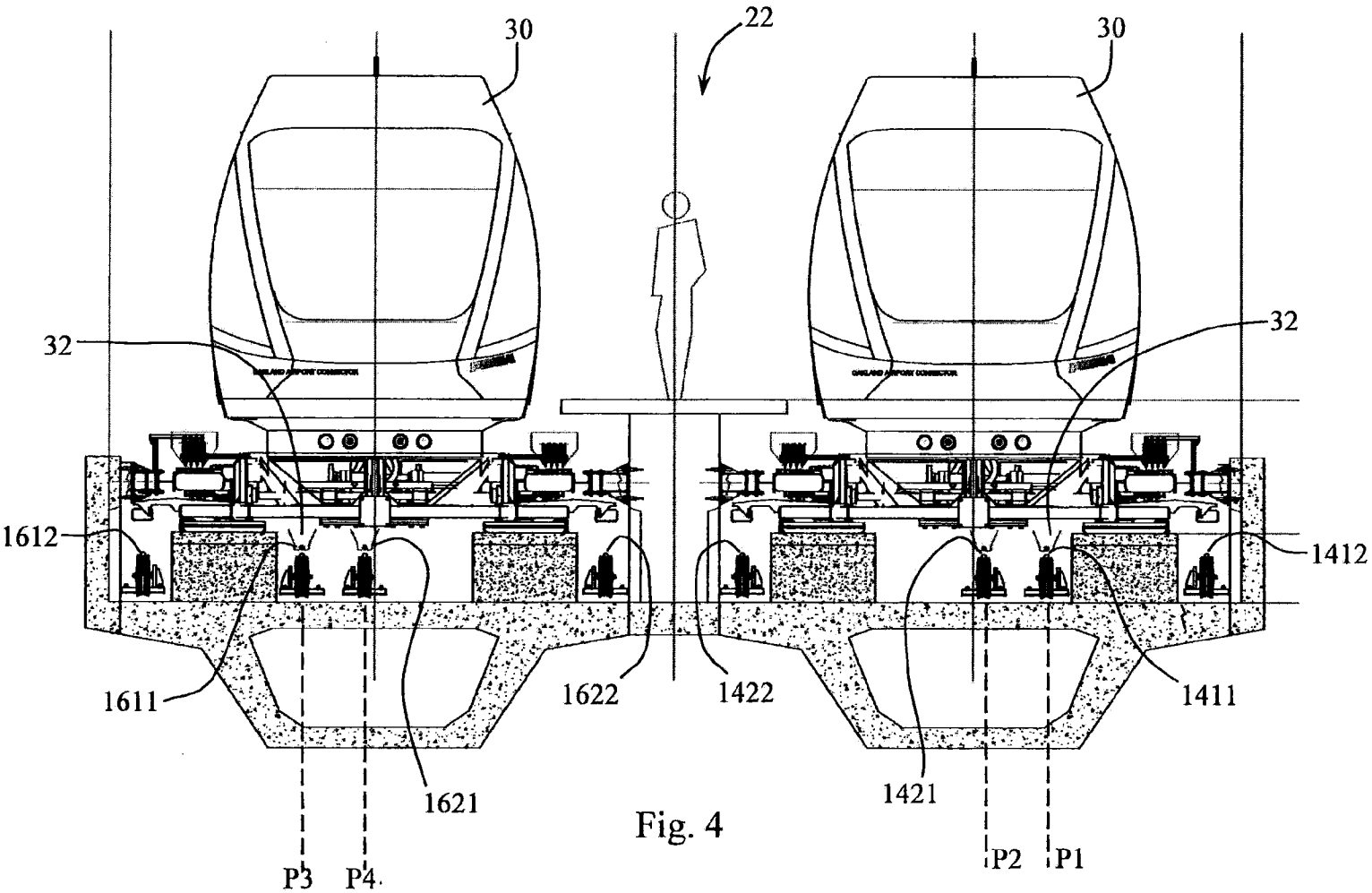
FIG. 4 is a section of the installation along line IV-IV of FIG. 1, showing a boarding platform of the installation.

Each of the endless cable 141, 142, 161, 162 includes a cruising thread 1411, 1421, 1611, 1621 for clamping the vehicles and a return thread 1412, 1422, 1612, 1622. In FIG. 3, the complete loop of one of the endless cables 141 is diagrammatically. The cruising thread 1411 is located directly below the track and extends between two end sheaves 1414A and 1414B on a path that includes the track 14 and the two connector track sections 18A, 18B. Support sheaves and maintaining sheaves as well as lateral sheaves may be added along the track so as to guide the main cruising thread 1411 parallel to the path of the track 14. The two end sheaves 1414A, 1414B transmit motion and power a power station 1416. The power station 1416 is preferably located at a distance from the end stations 12A, 12B where space may be scarce and noise should be avoided. This structure is repeated for each cable, so that each cable can be individually driven at continuously variable speed between standstill and a cruising speed. Ideally, the hauling direction of each cable can be reversed, to enable specific maintenance or safety operations on the installation. The power stations may include one electric motor per cable or a common electric motor with clutches and a continuously variable transmission.

The installation is operated as follows. In principle, each cable 141, 142, 161, 162 hauls only one vehicle 30 at a time, except for specific maintenance or safety operations. Hence, the number of vehicles 30 operating at any given time on the track does not exceed the number of hauling cables 141, 142, 161, 162. Additional vehicles may be parked on a parking track, e.g. behind the connector track sections.

Starting at one end station 12A on the connector track section 18A, a first vehicle 30 is coupled to one of the cables 141 associated to the outbound track 14 at standstill. The switch 20A is positioned towards the outbound track 14 and the cable is driven to haul the vehicle 30 to the passenger platform to let passengers board the vehicle. Once the boarding is completed, the speed of the first cable is progressively increased from zero to the cruising speed of the vehicle and the vehicle is driven towards the outbound end station.

In the meantime, a second vehicle travelling on the inbound track 16 hauled by one of the cables 161, 162 associated with the inbound track has reached the inbound platform of the end station 12A to let passenger alight. As the connector track section 18A is free, the switch 20A can be moved to let the inbound vehicle access the connector track section 18A. When the first vehicle has reached a predetermined position, e.g. midway between the two end stations 12A, 12B, the second vehicle is clamped to the second cable 142 associated with the outbound track 14 and driven to the outbound passenger platform for boarding. Once boarding is completed and the first vehicle has reached a second predetermined position, the second vehicle can leave the outbound passenger platform, hauled by the second cable 142. If more than two cables are associated with the outbound track, the operation is repeated for each cable.

When the first vehicle arrives at the outbound station 12B, it calls at the passenger platform to let the passengers alight. If the connector track section 18B of the outbound station 12B is free, the first vehicle, still hauled by the first cable 141 at low speed, can enter the connector track section 18B and stop. At standstill, the first vehicle can switch from the first cable 141 to one of the cables 161, 162 associated with the inbound track 16. As will be readily understood, a similar sequence is carried out simultaneously with inbound vehicles travelling from the outbound end station 12B to the inbound end station 12A.

In the operation sequence described above, all coupling and uncoupling operations are carried out at standstill, i.e. between a stationary vehicle and stationary cables. Moreover, and they are performed while no passenger is onboard the vehicle. Hence, the comfort for the passengers is optimal.

In case of defect of one of the cables or driving means while a vehicle is on the track, e.g. if the first cable 141 is brought unexpectedly to standstill while the first vehicle is travelling on the outbound track 14, the second cable 142 associated with the outbound track 14 is decelerated and stopped, irrespective of whether the second vehicle is already on the track or not. Once all vehicles travelling on the outbound track 14 and all cables 141, 142 associated with the outbound track 14 are at standstill, the first vehicle can be uncoupled from the first cable 141 and coupled to the second cable 142 (or any further cable associated with the outbound track). This can be done remotely or by maintenance staff onboard the vehicle by proper actuation of the clamp 40 from its position P1 associated with the first cable 141 to its position P2 associated with the second cable 142. The first vehicle clamped to the second cable 142 can be hauled to the outbound station 12B. If the second vehicle is also clamped to the second cable 142, this rescue operation is done at low speed.

Alternatively, it is also possible, before the first vehicle is clamped to the second cable 142, to run the second cable 142 in the reverse direction to haul the second vehicle back to the inbound end station 12A, so that passengers in the second vehicle do not have to stay onboard the second vehicle during the rescue operation. In the figures, the vehicles 30 are supported on air cushions 34 and laterally guided via rollers 36, which roll on lateral guiding rails 38 of the tracks.

The invention is not limited to the embodiments described hereinbefore. According to a non-illustrated variant, the connector track section can also include the passenger platform. The power station for driving the cables can be located at one of the end stations. The cables are not necessarily located below the track. The vehicles can be supported on wheels or air cushions. The track may include one or more guiding and/or supporting rails.

What is claimed is:

1. A transport installation comprising:

two end stations;

independent vehicles;

a first and a second track, each supporting and guiding the vehicles from one of the two end stations to the other;

a plurality of first endless traction cables associated to the first track, each for individually hauling one of the vehicles along the first track from one of the two end stations to the other;

a plurality of second endless traction cables associated with the second track, each for individually hauling one of the vehicles along the second track from one of the two end stations to the other;

at least one coupling connecting the vehicles to any one of the first and second endless traction cables; and a driver independently driving each of the first and second cables;

wherein the coupling includes detachable cable grips mounted on each of the vehicles; and wherein each of the detachable grips is movable between four positions offset laterally in relation to each other, each of the four positions enabling the grip to clamp a respective one of the first and second endless traction cables.

2. The installation of claim 1, wherein the first cables are laterally offset with respect to one another by a distance which is constant along the first track.

3. The installation of claim 1, wherein the second cables are laterally offset with respect to one another by a distance which is constant along the second track and equals the distance between the first cables.

4. The installation of claim 1, wherein the cables of the first and second pairs are located below the first and second tracks, respectively.

5. The installation of claim 1, further comprising a collision preventor operably detecting a loss of traction of any one of the first and second cables.

6. A transport installation comprising:

two end stations;

independent vehicles;

a first and a second track, each supporting and guiding the vehicles from one of the two end stations to the other;

a plurality of first endless traction cables associated to the first track, each for individually hauling one of the vehicles along the first track from one of the two end stations to the other;

a plurality of second endless traction cables associated with the second track, each for individually hauling one of the vehicles along the second track from one of the two end stations to the other;

at least one coupling connecting the vehicles to any one of the first and second endless traction cables; and a driver independently driving each of the first and second cables;

wherein each of the stations includes a connector track section, where the first and second cables run in parallel and are laterally offset with respect to one another, such that any one of the vehicles staying on the connector track section can switch from any one of the first and second cables to any other one.

7. The installation of claim 6, wherein the cables are located below the tracks.

8. The installation of claim 6, further comprising a collision preventor operably detecting a loss of traction of any one of the first and second cables.

9. A transport installation comprising:

two end stations;

independent vehicles;

a first and a second track, each supporting and guiding the vehicles from one of the two end stations to the other;

a plurality of first endless traction cables associated to the first track, each for individually hauling one of the vehicles along the first track from one of the two end stations to the other;

a plurality of second endless traction cables associated with the second track, each for individually hauling one of the vehicles along the second track from one of the two end stations to the other;

at least one coupling connecting the vehicles to any one of the first and second endless traction cables; and a driver independently driving each of the first and second cables;

wherein each of the stations includes a connector track section, where the first and second cables run in parallel and are laterally offset with respect to one another, such that any one of the vehicles staying on the connector track section can switch from any one of the first and second cables to any other one; and wherein the single connector track section of each of the stations is connected to the first and second tracks via a switch.

10. The installation of claim 9, wherein the first cables are laterally offset with respect to one another by a distance which is constant along the first track.

11. The installation of claim 9, wherein the second cables are laterally offset with respect to one another by a distance which is constant along the second track and equals the distance between the first cables.

12. The installation of claim 9, wherein the cables are located below the tracks.

13. The installation of claim 9, further comprising a collision preventor operably detecting a loss of traction of any one of the first and second cables.

14. The installation of claim 9, wherein the vehicles are passenger-carrying vehicles, all coupling and uncoupling operations are carried out when the vehicles and cables are stationary and there are no passengers onboard the vehicles, and one of the end stations includes a power station with the driver.

15. A transport installation comprising:

two end stations;

independent vehicles;

a first and a second track, each supporting and guiding the vehicles from one of the two end stations to the other;

a plurality of first endless traction cables associated to the first track, each for individually hauling one of the vehicles along the first track from one of the two end stations to the other;

a plurality of second endless traction cables associated with the second track, each for individually hauling one of the vehicles along the second track from one of the two end stations to the other;

at least one coupling connecting the vehicles to any one of the first and second endless traction cables;

a driver independently driving each of the first and second cables; and a synchronizer operably controlling the driver such that none of the vehicles enters one of the connectors track sections in presence of another vehicle.

16. The installation of claim 15, wherein the cables are located below the tracks.

17. The installation of claim 15, further comprising a collision preventor operably detecting a loss of traction of any one of the first and second cables.

18. The installation of claim 15, wherein the first cables are laterally offset with respect to one another by a distance which is constant along the first track.

19. The installation of claim 15, wherein the second cables are laterally offset with respect to one another by a distance which is constant along the second track and equals the distance between the first cables.

20. The installation of claim 15, wherein the vehicles are passenger-carrying vehicles, all coupling and uncoupling operations are carried out when the vehicles and cables are stationary and there are no passengers onboard the vehicles, and one of the end stations includes a power station with the driver.

* * * * *